United States Patent [19]

Smith

[11] 4,398,168

[45] Aug. 9, 1983

[54] SWITCHING MECHANISM

[75] Inventor: John W. Smith, Indianapolis, Ind.

[73] Assignee: Emhart Industries, Inc., Indianapolis, Ind.

[21] Appl. No.: 356,834

[22] Filed: Mar. 10, 1982

[51] Int. Cl.[3] ..... H01H 71/16

[52] U.S. Cl. ..... 337/58; 335/128; 200/6 R; 200/339

[58] Field of Search ..... 337/58; 200/6 R, 6 B, 200/339; 335/128

[56] References Cited

U.S. PATENT DOCUMENTS

| | | | |
|---|---|---|---|
| 2,966,559 | 12/1960 | Meyer | 200/6 R |
| 3,196,220 | 7/1965 | Brown | 200/6 R |
| 3,223,791 | 12/1965 | Wanlass | 200/6 R |
| 3,408,463 | 10/1968 | Wanlass | 200/6 R |

*Primary Examiner*—George Harris

*Attorney, Agent, or Firm*—Robert F. Meyer; David W. Gomes

[57] ABSTRACT

Electrically conductive paths are selectively engaged by a pair of electrical contacts that are carried in a pair of holders. Each holder is pivoted by an actuator. Each holder also carries a spring biased detent plunger that cooperates with V-shaped cavities in a switch housing to provide an over-center feel.

7 Claims, 4 Drawing Figures

SWITCHING MECHANISM

BACKGROUND OF THE INVENTION

Generally speaking, the present invention relates to a switch mechanism which comprises: a housing including a cup-shaped member having sidewalls, a base, and an open end, and a cover closing the open end; a pivotally mounted actuator carried in a sidewall; electrically conductive paths carried by the base; a pair of electrical contact assemblies each including a holder pivotally carried on the base and spring biased between the base and the cover, and further engaging the actuator to be pivoted thereby, electrical contact means carried by the holder and selectively engaging the electrically conductive paths, and a spring biased detent plunger carried by the holder; and a pair of detent cavities carried by the cover and adapted to receive the plunger.

The present invention relates to a switch mechanism which is particularly adaptable for use in automobiles to operate parking lights and headlights.

In the design of such switch mechanisms, space requirements are always at a premium. The present invention meets such requirements by utilizing a rocker type push-button which permits both the parking lights and the headlights to be turned off simultaneously while permitting the parking lights to be turned on individually.

It is also very desirable to provide an "over-center feel" in such switch mechanisms. Not only does such a feel make the switch more reliable, but it gives the operator of the switch a good positive feel that the switch is completing its throw and not being hung up.

FEATURES OR OBJECTS OF THE INVENTION

It is a feature of the present invention to provide a switch mechanism using a rocker type actuator that is simple and compact in design. Another feature of the invention is to provide such a switch mechanism wherein an individual function may be operated separately while permitting the two individual functions to be activated or deactivated simultaneously. Another feature of the invention is to provide such a switch mechanism having a positive over-center feel. Still another feature of the invention is to provide such a switch mechanism wherein the over-center feel is provided by a spring biased plunger in conjunction with a V-shaped cavity. Yet another feature of the invention is to provide such a switch mechanism wherein a pivotally mounted actuator selectively engages a pair of electrical contact assemblies to selectively cause engagement of electrical contacts with electrically conductive paths. A further feature of the invention is to provide such a switch mechanism wherein the pivotally mounted actuator includes two independently operable members, one each engaging one of the electrical contact assemblies. Another feature of the invention is to provide such a switch mechanism wherein a lost-motion connection between the two members permits the members to be selectively operated simultaneously. These and other features of the invention will become apparent from the following description taken in conjunction with the accompanying drawings.

DETAILED DESCRIPTION OF THE INVENTION

Figure 1:
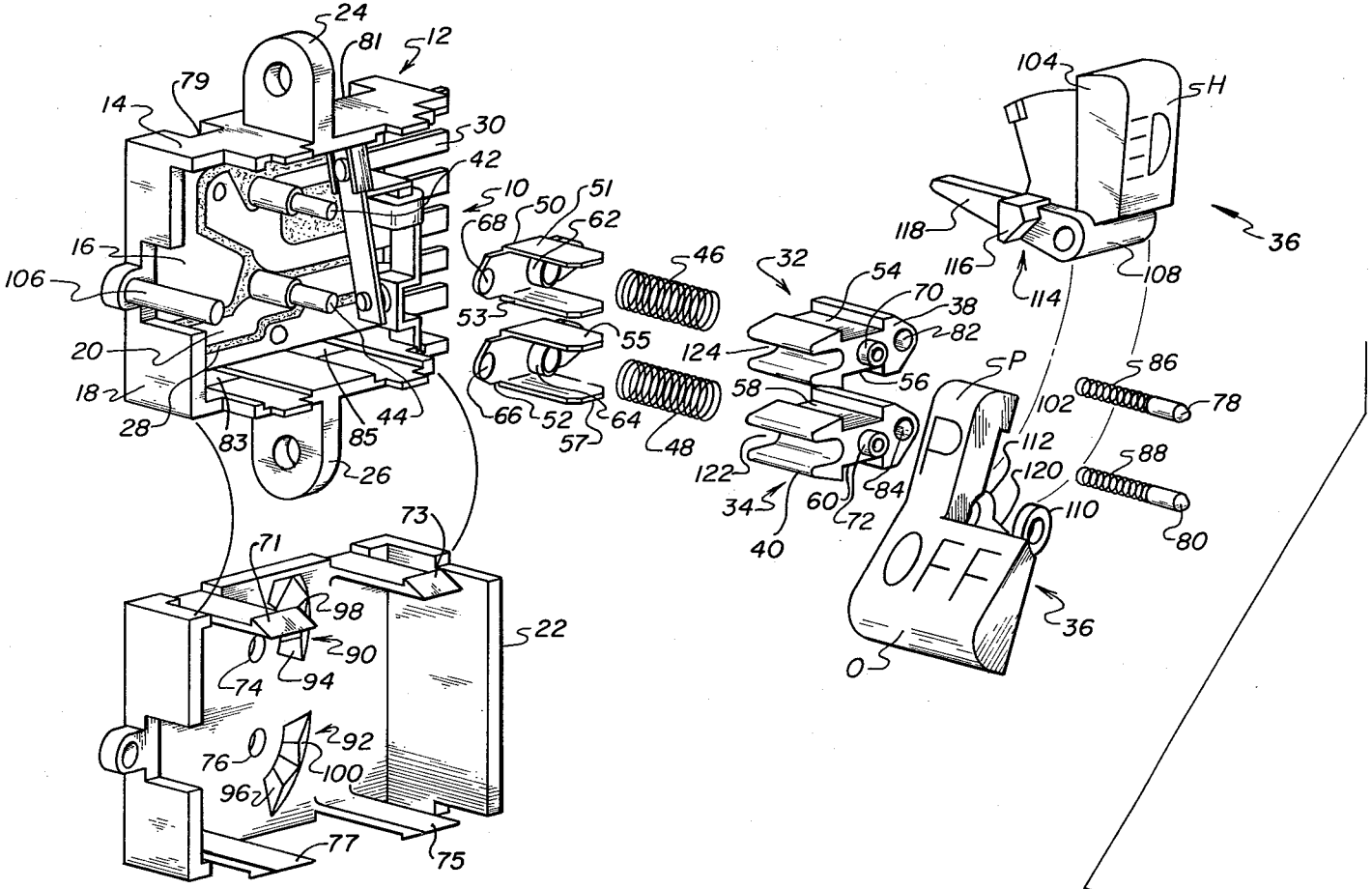
FIG. 1 is an exploded view of a switch mechanism employing the features of the invention.

Referring now to the drawings, and particularly to FIG. 1, there is shown switch mechanism 10 which embodies the features of the invention. The elements of the switch are contained within a housing 12 which includes a cup-shaped member 14 having a base 16, sidewalls 18 and an open end 20 which is closed by a cover 22. Ears 24 and 26 permit the switch to be mounted in any suitable place. In general, the switch elements include a plurality of electrical conductive paths 28 carried on the base 20 of the cup-shaped member and electrically connected to electrical terminals 30 which extend outside the housing. A suitable material for the electrical paths would be copper, for example. The switch also includes a pair of electrical contact assemblies 32 and 34 and an actuator 36.

Each of the electrical contact assemblies include holders 38 and 40 which are pivotally mounted on posts 42 and 44 and are axially spring biased thereon through coil springs 46 and 48. Each electrical contact assembly also includes electrical contacts 50 and 52 that are carried on the holders through ears 51, 53, 55 and 57 engaging slots 54, 56, 58 and 60. Coil springs 46 and 48 are carried within a cavity (not shown) of the holders and hub portions 62 and 64 of the electrical contacts. Each electrical contact includes a pair of opposed contact buttons 66 and 68 which engages the electrical contact paths 28. A suitable material for the electrical contacts would be copper, for example. The holders are held in position on the posts 42 and 44 through hub portions 70 and 72 engaging apertures 74 and 76 when cover 22 is placed over the cup-shaped member 14 and tightened into position through spring tabs 71, 73, 75 and 77 engaging slots 79, 81, 83 and 85.

Each of the electrical contact assemblies also include spring biased hollow plungers 78 and 80 that are carried in cavities 82 and 84, the plungers being spring biased through coil springs 86 and 88 which are carried in the hollow plungers and inserted into the cavities. Plungers 78 and 80 in conjunction with ramp means 90 and 92 carried in cavities 94 and 96 provide a detent means for the switch and, as will be hereinafter explained, provide the over-center feel of the switch. As shown, each of the ramp means 90 and 92 are provided by a V-shaped member 98 and 100.

Actuator means 36 includes two independently operable buttons 102 and 104 which are pivotally carried on post 106. Sleeve 108 of button 104 fits between ears 110 and 112 of button 102 and then both buttons are pivotally mounted on post 106 through the apertures in the ears and the sleeve. A lost-motion connection means 114 is provided between the buttons such that they can be operated either independently or simultaneously. Lost-motion connection means 114 includes a tab 116 which extends from arm 118 of button 104 and engages arm 120 of button 102. Each of the arms 118 and 120 engage slots 122 and 124 of holders 38 and 40. Manual actuation of either of the buttons 102 and 104 causes holders 38 and 40 to pivot by way of arms 118 and 120 engaging slots 122 and 124.

Figure 2:
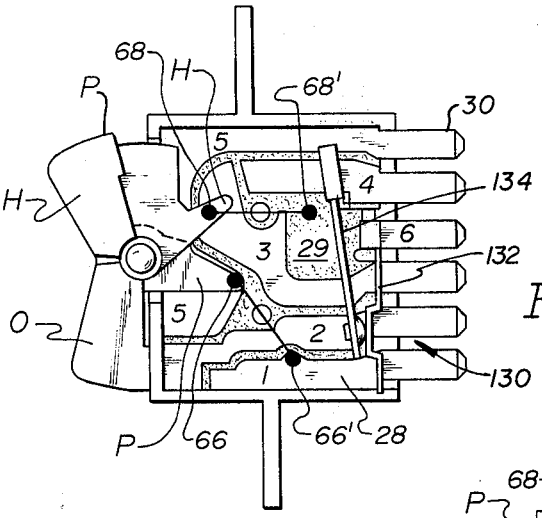
FIGS. 2–4 are similar sectional and partially schematic views showing different operating modes of the switch mechanism.
Figure 3:
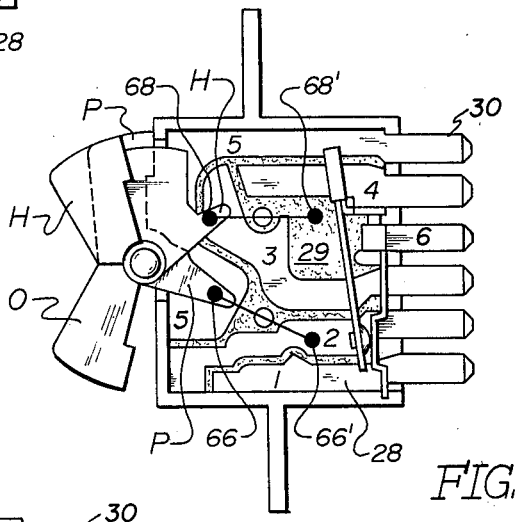
Figure 4:
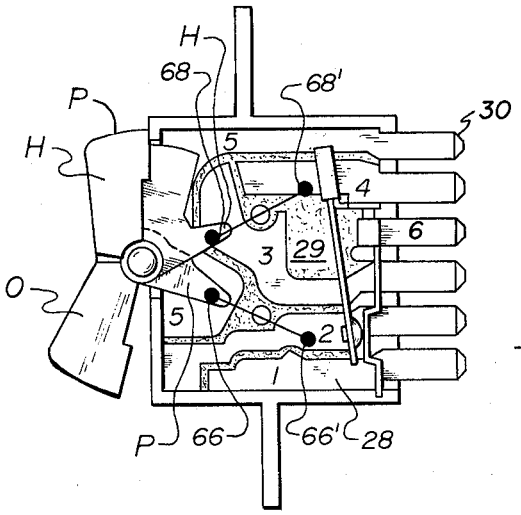

As shown in FIG. 1, the buttons 102 and 104 are illustrated as being used for turning on and off lights of an automobile. Button 102 controls the headlights H, while button 104 controls both the parking lights P and the "off" switch O. Referring to FIGS. 2–4, the operation of the switch can now be described.

As shown in FIGS. 2–4, there are five numbered electrically conductive paths 28. Also the oppositely disposed pair of contact buttons 66 and 68 described with reference to FIG. 1, are schematically illustrated in FIGS. 2–4 as 66, 66' and 68, 68'. In FIG. 2, the "off" button O has been depressed. The contacts 66 and 66' of button P have engaged electrical paths 1 and 5 to provide a warning circuit for the parking lights. Simultaneously through lost-motion connection 114 (FIG. 1), contact 68' of button H has moved to electrically insulative island 29 to open the headlight circuit.

In FIG. 3, button P has been depressed independently of the headlight button H to raise the "off" button and complete a circuitry through paths 2 and 5 through buttons 66 and 66' to energize the parking lights. Contacts 68 and 68' remain the same. In FIG. 4, button H has been depressed to complete a circuit through paths 3 and 4 by contacts 68 and 68' to energize the headlights. Contacts 66 and 66' remain engaged with electrical paths 2 and 5, button P having not been actuated.

Referring to FIG. 2, as an additional feature of the invention, an overload switch 130 has been provided. The switch is of the commonly used bi-metal type and includes a fixed electrical blade 132 that is connected to electrical terminal 6 and a movable bi-metal blade and electrical contact 134 that is connected to path 4. Upon overloading of the headlight circuit, heat will cause the bi-metal to move blade 134 and open the electrical circuit through paths 4 and 6 to open the headlight circuit.

What is claimed is:

1. A switch mechanism comprising:

(a) a housing, (b) a pivotally mounted actuator carried in said housing, (c) electrically conductive paths carried by a base of said housing, (d) a pair of electrical contact assemblies each including a holder pivotally carried on said base and spring biased between said base and a wall of said housing, and further engaging said actuator to be pivoted thereby, electrical contact means carried by said holder and selectively engaging said electrically conductive paths, and a spring biased detent plunger carried by said holder, and (e) a pair of detent cavities carried by said wall and adapted to receive said plunger.

2. A switch mechanism according to claim 1 wherein said detent cavities each include ramp means.

3. A switch mechanism according to claim 2 wherein said ramp means includes a V-shaped member.

4. A switch mechanism according to claim 1 wherein said actuator includes two independently operable members one each engaging said holder.

5. A switch mechanism according to claim 4 further including lost-motion connection means carried by at least one of said independently operable members whereby said member can be selectively pivoted simultaneously.

6. A switch mechanism according to claim 5 wherein said lost-motion connection means includes a tab carried by said one independently operable members adapted to engage the other of said independently operable members.

7. A switch mechanism according to claim 1 further including a bi-metallic switch means electrically bridging two of said electrically conductive paths.

* * * * *